US009221084B2

(12) United States Patent
Palmer

(10) Patent No.: US 9,221,084 B2
(45) Date of Patent: Dec. 29, 2015

(54) CLEANING BRUSH

(75) Inventor: Jane Palmer, Halesowen (GB)

(73) Assignee: Industrial Brushware Limited, Halesowen (GB)

( * ) Notice: Subject to any disclaimer, the term of this patent is extended or adjusted under 35 U.S.C. 154(b) by 0 days.

(21) Appl. No.: 13/642,270

(22) PCT Filed: Apr. 20, 2011

(86) PCT No.: PCT/GB2011/000616

§ 371 (c)(1), (2), (4) Date: Jan. 21, 2013

(87) PCT Pub. No.: WO2011/131939

PCT Pub. Date: Oct. 27, 2011

(65) Prior Publication Data

US 2013/0205523 A1 Aug. 15, 2013

(30) Foreign Application Priority Data

Apr. 21, 2010 (GB) ..... 1006612.4

(51) Int. Cl.

| | |
|---|---|
| ***A46B 7/10*** | (2006.01) |
| ***B08B 9/043*** | (2006.01) |
| ***B08B 9/045*** | (2006.01) |
| ***A46B 5/00*** | (2006.01) |
| *A46B 13/00* | (2006.01) |

(52) U.S. Cl.

CPC ..... *B08B 9/0436* (2013.01); *A46B 5/0095* (2013.01); *A46B 7/10* (2013.01); *B08B 9/045* (2013.01); *A46B 13/006* (2013.01); *A46B 2200/3013* (2013.01)

(58) Field of Classification Search

CPC ..... B08B 9/043; B08B 9/045; B08B 9/0436; A46B 7/10; A46B 13/006

USPC ..... 15/104.2, 104.09, 182

See application file for complete search history.

(56) References Cited

U.S. PATENT DOCUMENTS

| | | | | |
|---|---|---|---|---|
| 3,386,118 | A | 6/1968 | Morioku et al. | |
| 5,450,646 | A * | 9/1995 | McHugh | A47L 17/04 15/179 |
| 5,452,490 | A | 9/1995 | Brundula et al. | |
| 5,819,353 | A * | 10/1998 | Armell et al. | 15/104.2 |
| 6,464,010 | B1 | 10/2002 | Brown | |
| 7,694,377 | B2 * | 4/2010 | Bourrelly | 15/104.095 |

FOREIGN PATENT DOCUMENTS

| | | |
|---|---|---|
| GB | 809526 | 2/1959 |
| JP | 60197358 | 10/1985 |
| SU | 689657 | 5/1979 |

* cited by examiner

*Primary Examiner* — Randall Chin

(74) *Attorney, Agent, or Firm* — DeLio, Peterson & Curcio, LLC; Peter W. Peterson

(57) ABSTRACT

A cleaning tool (100) for a pipe is provided comprising a substantially cylindrical body (102) and a plurality of holes within the body section (102) for receiving resilient biasing means. A plurality of bristle heads (104) extend radially from the body. Each bristle head (104) is movable between an extended position and an inward position and the biasing means bias the bristle heads in the direction of the extended position. A housing may be provided for each resilient biasing means that is received in each of the plurality of the holes in the body.

20 Claims, 4 Drawing Sheets

CLEANING BRUSH

BACKGROUND OF THE INVENTION

1. Field of the Invention

This invention relates to cleaning brushes, in particular this invention relates to cleaning brushes that are passed down the centre of pipes to clean the internal surfaces thereof.

2. Description of Related Art

Pipe cleaning brushes for cleaning the inside of pipes are well known in the art and typically comprise a body and a plurality of bristles extending radially from the body. As the assembly is passed down a pipe the bristles clean the interior of the pipe.

As the passage of the cleaning devices down the centre of a pipe is dependent on the frictional contact between the bristles and the pipe wall such devices are sized to form a desired fit with a desired pipe internal diameter.

If the devices need to pass around corners in pipes then typically the body may be sprung along its axial end so that the ends of the device can resiliently move relative to one another. Furthermore the fixed size of such devices results in increased friction and the possibility of the device getting jammed where, for example seam weld lines project radially into the pipe or where there is a large build up of solids on the interior surface of the pipe.

Some devices are modular in nature and enable circular sections of the device comprising part of the body and some radially arranged bristles on to be removed and replaced, for example if they become damaged. However such removal is complex and typically requires substantive disassembly of the device in order for the section to be removed.

BRIEF SUMMARY OF THE INVENTION

It is the purpose of the present invention to provide an improved cleaning tool for a pipe.

According to the present invention there is provided a cleaning tool for a pipe comprising: a substantially cylindrical body; a plurality of holes within the body section for receiving resilient biasing means; and a plurality of bristle heads extending radially from the body; wherein: each bristle head is movable between an extended position and an inward position and wherein the biasing means bias the bristle heads in the direction of the extended position.

By having resiliently outwardly biasing bristles that can be moved into an inward position several advantages are achieved including: the adaptability of the cleaning tool to different sized pipes; the ability of the cleaning tool to pass over obstacles on the interior surface of the pipe, for example seam weld lines and deposit build ups that can not be removed by the cleaning tool; and the ability to pass easily around corners without the need for the whole body to be resilient.

In a preferred arrangement the body has a central axial bore running therethrough which is preferably fluidicly isolated from the external surface of the body. In this manner the tool may be used for cleaning down pipes from well heads where a first fluid is pumped down the centre of the pipe to force oil up the outside of the first fluid. The isolated central bore enables this first fluid to pass the cleaning tool without becoming obstructed or without mixing with the oil.

The bristle heads are preferably individually removable.

In a preferred arrangement the cleaning tool further comprises a housing for each resilient biasing means that is received in each of the plurality of the holes in the body. Preferably each bristle head is attached to a respective housing. By this design the tool is simply manufactured without the need of complex machining of the interior of the body and maximum through flow through the central bore is achieved.

In one preferred arrangement each housing extends substantially across the central axial bore.

The bristle heads may be helically arranged around the body and preferably there are two rows of bristle heads arranged about the body and extending therefrom in substantially opposite directions. More preferably the housings are offset from the body diameter such that there is a central unobstructed flow path along the central axis of the cleaning tool. One advantage of this is that the provision of a central unobstructed flow path through the centre of the tool facilitates the through flow of a fluid being pumped therethrough to force oil to rise in the pipe. In addition to the through flow through the unobstructed flow path fluid will also flow through the rest of the central bore around and between the housings.

In a preferred arrangement the external surface of the body has at least one bristle bypass channel therein extending substantially from one end of the body to the other. Preferably the cleaning channel is helical and preferably the cleaning tool comprises two cleaning channels substantially opposite one another. The provision of bypass channels enables the product flowing in the pipe, for example crude oil being forced up a wellhead down pipe, to pass by the cleaning tool without too great a restriction. The helical bypass channels encourage the fluid to flow in a helical pattern around the tool which assists in removing any debris cleaned from the pipe by the tool, to become entrained in the flow so as not to block the bristles. Furthermore a small vortex can be created (dependent of process properties, fluid density, flow rate, etc.) immediately after the fluid passes the tool which further helps any debris to become fully entrained in the fluid flow which reduces the likelihood of it becoming reattached to the pipe walls.

In a preferred arrangement the cleaning tool has attachment means at either end thereof. Preferably the attachment means are configured for attachment to a hollow pipe such that the pipe and the central bore of the cleaning tool form a continuous flow path isolated from the external surface of the cleaning tool. In this manner the pipe carrying fluid down a well to displace oil towards the surface can be attached to either end of the cleaning tool so that it becomes integral within that pipe.

The resilient biasing means preferably comprise springs.

In one embodiment the springs may be located in the housings and with a bristle head removed, the spring can be removed from the housing. As each bristle head can be independently removed and as with the bristle heads removed the springs can be removed from the housings this greatly facilitates the maintenance of the tool. It is a simple procedure to maintain the tool, for example a bristle head can be easily changed if it becomes damaged by someone of little maintenance skill. This enables quick and easy repairs to be conducted on location without the need to return the product to the manufacturer or a dedicated after sales maintenance team.

Specific embodiments of the invention will now be described, by way of example only, with reference to the following drawings in which:

DETAILED DESCRIPTION OF THE INVENTION

Referring to the Figures a cleaning tool 100 is shown that has a body 102 and a plurality of bristle heads 104 extending therefrom. Although the bristle heads are depicted as a cylinder it will be appreciated that these bristle heads will be made up of a plurality of bristles which may be of any type known in the art and suitable for the application in which the tool is being used. When, for example, the tool 100 is being used for cleaning the inside of a wellhead down pipe the bristles will be made of steel. It will also be appreciated that the bristles may be arranged in cross sectional shapes other than round, for example the bristle heads 104 may have a square or star shaped cross section.

Figure 1:
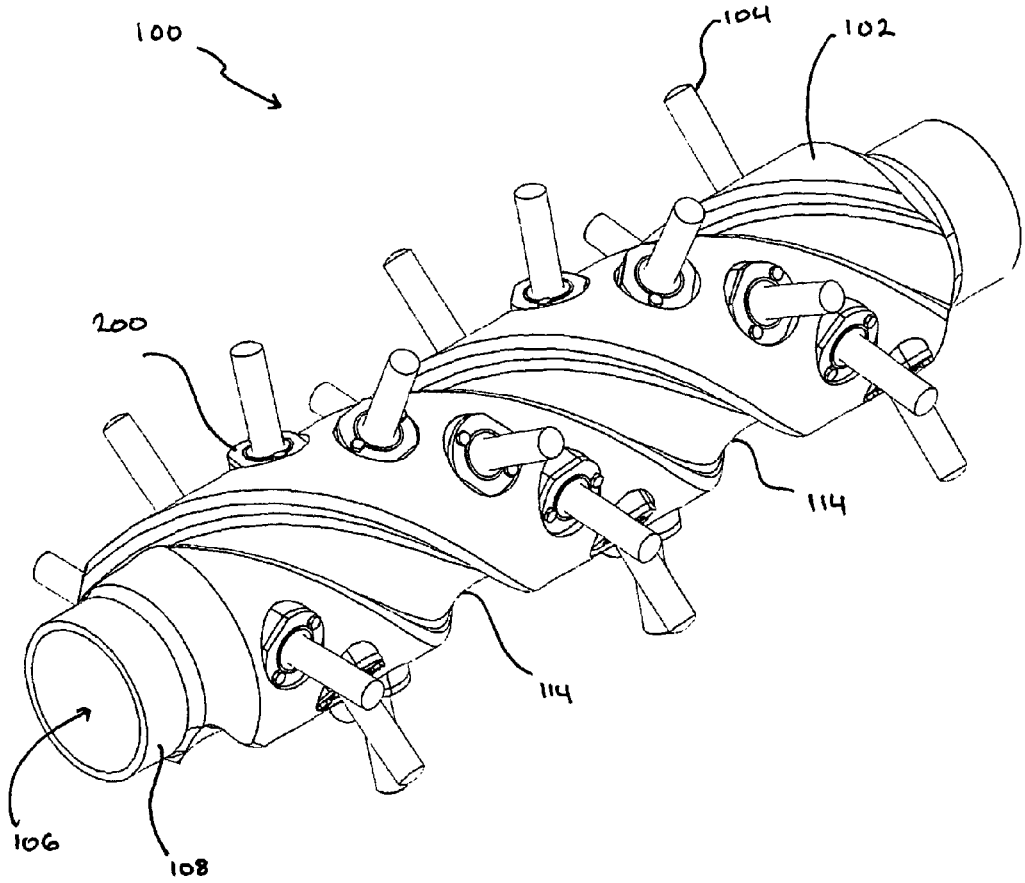
FIG. 1 is a perspective view of a cleaning tool in accordance with the invention.
Figure 2:
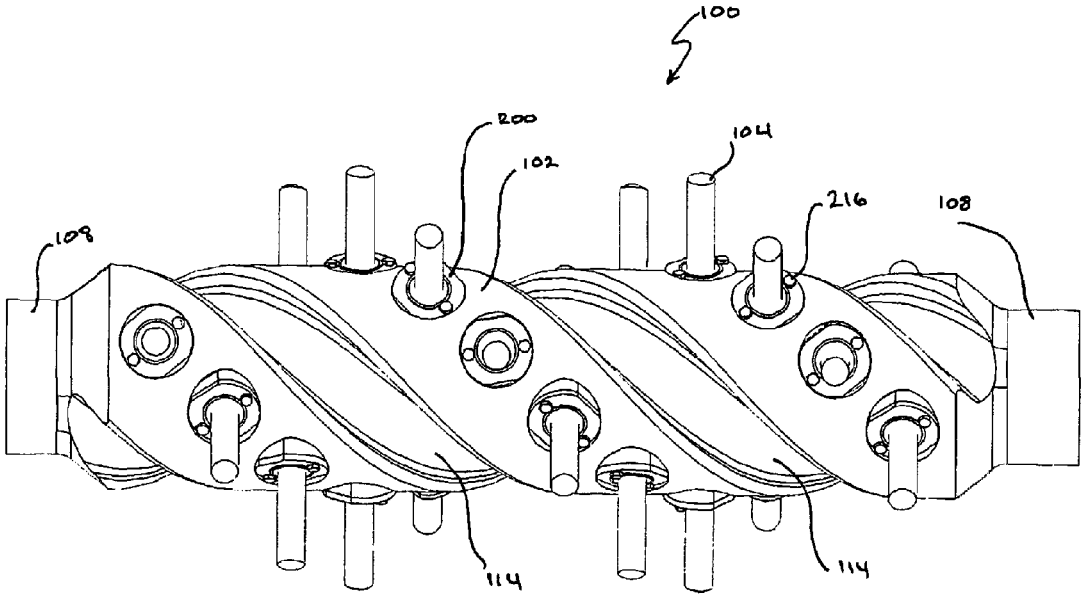
FIG. 2 is a side view of the cleaning tool of FIG. 1.
Figure 3:
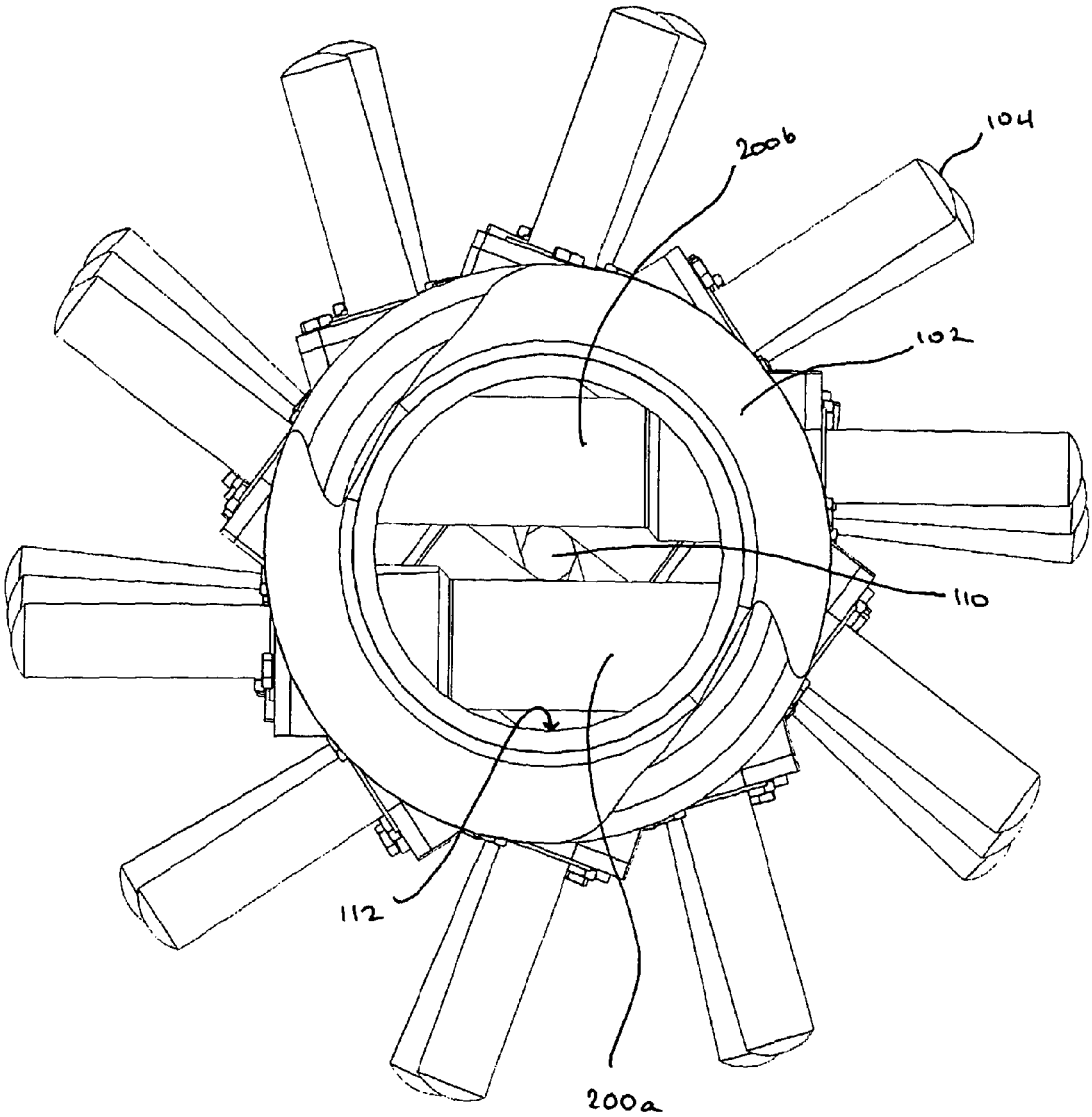
FIG. 3 is an end view of the cleaning tool of FIG. 1.
Figure 4:
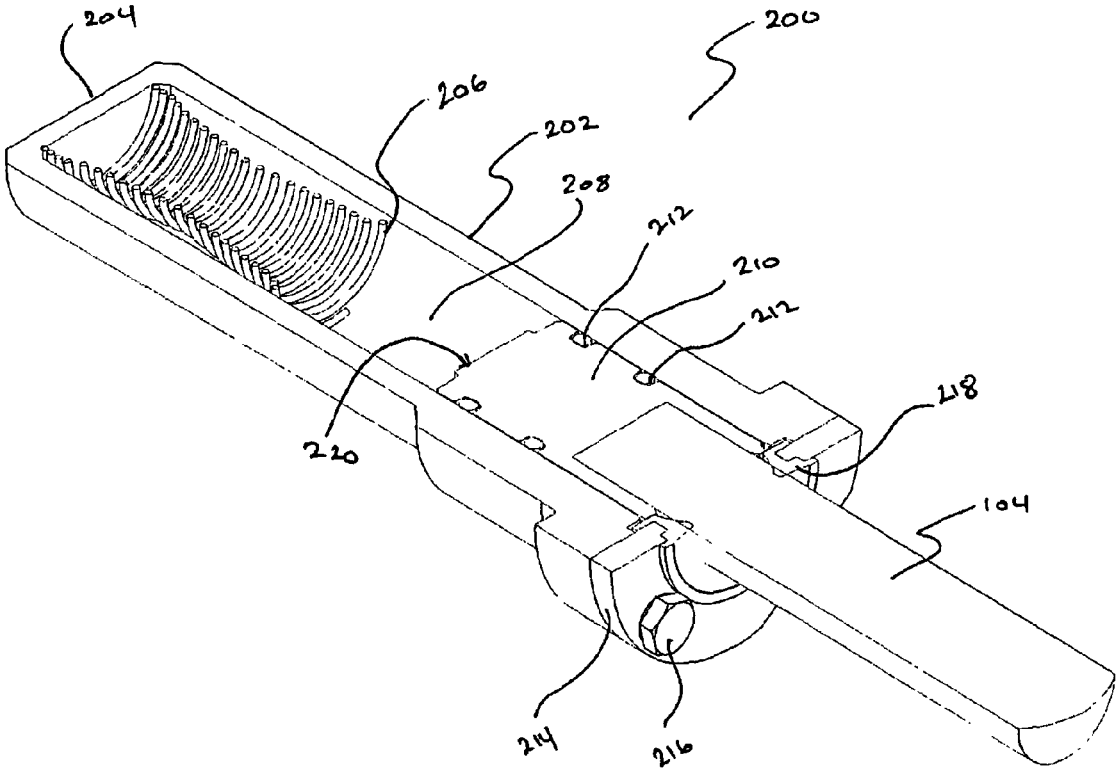
FIG. 4 is a cross section of a housing and bristle head of the invention.

The body comprises a generally tubular section that has a hollow bore 106 running therethrough and attachment means 108 by which a pipe can be attached to each end of the cleaning tool 100. The body 102 has a plurality of holes along its length in which brush inserts 200 (shown in detail in FIG. 4) are located.

Each brush insert 200 comprises a hollow housing 202 closed at one end 204 to form a chamber 208. Biasing means, in this case a spring 206, is located within the recess. Located in the open end of the housing is a bristle head 104 that is set into a piston 210 that is slidable in the chamber so that the bristle head 104 can move into and out of the chamber. The piston 210 has seals 212 around its outer edge to prevent the ingress of fluid into the chamber 208. An end cap 214 is attached to the housing 202 by means of threaded bolts 216. The end cap has an edge seal 218 that further prevents the ingress of fluid into the chamber and which prevents the piston 210 from exiting the chamber 208. The spring 206 is shown in its compressed state and it will be appreciated that, in fact, with the piston 210 at its outermost position as shown the spring 206 would in fact uncompress so as to be in contact with the inward face 220 of the piston 210, thereby resiliently biasing the cleaning head into an extended position.

The brush inserts 200 are arranged in a helical pattern substantially along the length of the body 102. The inserts are arranged in pairs 200*a*, 200*b* extending substantially from opposite sides of the body 102 so as to form two helical rows of inserts. The pairs of inserts 200*a*, 200*b* are each offset from the diameter of the body 102 by a sufficient distance that a clear space exists between the two inserts in each pair and adjacent pairs are angularly offset from each other to form the double helix pattern. By ensuring that the inserts 200*a*, 200*b* of each pair are offset from the body diameter an unobstructed flow path 110 passes through the centre of the body 102 from one end to the other. Extending between this unobstructed flow path 110 and the interior wall 112 of the body is a convolute flow path through and around the inserts 200.

If the bristle heads become damaged or worn through use they can simply be removed and new ones installed in a simple and relatively unskilled manner. This is greatly beneficial as it enables repairs to the tool to be quickly and simply effected in location without the need for disassembly of the tool or return of the tool to the manufacturer.

The exterior surface of the body 102 has two helical bypass channels 114 therein interposed between the two helical rows of bristle inserts 200. The bypass channel gives additional space between the rows of bristles for fluid to flow around the outside of the body. As the bypass channels 114 have a helical shape they encourage the flow passing therethrough to flow in a helical manner. This creates a small vortex in the fluid as it exits the bypass channels 114 which assists in entraining any debris removed by the bristle heads 104 into the flow and may assist in preventing reattachment of the debris to the pipe walls being cleaned.

One preferred use of the invention is for cleaning pipes that carry oil to the surface at oil wells. These pipes can comprise two flow channels, a central flow channel through which a replacement fluid, for example seawater, is pumped underground into the oil reservoir to pressurize it and replace extracted oil, and an outer channel through which oil flows from the well to the surface. A conduit typically separates the two flow paths and the conduit typically terminates deeper underground than the pipe so that the sea water is not deposited in the immediate vicinity of the pipe inlet and is typically movable in the pipe. The cleaning tool of the invention can be attached, by its attachment means 108 inline in this conduit and can then be moved up and down the pipe attached to the conduit. As the tool has a central bore 106 passing therethrough the sea water can still pass through the conduit and the bypass channels allow for easy passage of the oil past the tool in the outer channel. In this manner production can largely be maintained during cleaning. As the bristle heads are resiliently biased and are movable from an extended position and an inward position the same tool can be used for more than one size of pipe diameter.

When used in this manner the ease of replacement of the bristle heads is particularly advantageous as, if the tool is pulled clear of the pipe they can be replaced without the need to remove the tool from the conduit.

Although described with reference to one specific application it will be appreciated that the tool of the invention may be used in all sorts of pipelines where the benefits of the resiliently biased bristle heads apply. In such instances the tool may be connected to a means to pull or push it through the pipe.

In use the passage of fluid past the tool 100, through the bypass channels 114, will impart a turning force on the tool. Accordingly in some arrangements it may be advantageous that the tool be attached to whatever the means of propelling it along the pipe is by a rotatable connection to enable it to turn freely without imparting a turning force on the means to pull or push it through the pipe.

Variations of the invention will be apparent to those skilled in the art within the scope of the claims.

The invention claimed is:

1. A cleaning tool for a pipe comprising:

a cylindrical body;

a plurality of holes within the cylindrical body;

brush inserts located within the plurality of holes wherein the brush inserts each comprise a housing closed at one end to form a chamber in which a spring is located and a bristle head is located in an open end of the chamber of the housing, permitting the bristle heads to extend radially from the substantially cylindrical body, each bristle head being made up of a plurality of bristles;

wherein each bristle head is movable between an extended position and an inward position and wherein the springs resiliently bias the bristle heads out of the chamber in the direction of the extended position.

2. A cleaning tool according to claim 1 wherein the body has a central axial bore running therethrough.

3. A cleaning tool according to claim 2 wherein the central axial bore is fluidicly isolated from an external surface of the body.

4. A cleaning tool according to claim 1 wherein the bristle heads are individually removable.

5. A cleaning tool according to claim 1 having attachment means at either end of the cylindrical body.

6. A cleaning tool according to claim 5 wherein the attachment means are configured for attachment to a hollow pipe such that the pipe and a central axial bore of the cleaning tool form a continuous flow path isolated from an external surface of the cleaning tool.

7. A cleaning tool for a pipe comprising:

a substantially cylindrical body;

a plurality of holes within the substantially cylindrical body for receiving springs;

a housing for each spring that is received in each of the plurality of the holes in the body; and a plurality of bristle heads extending radially from the substantially cylindrical body;

wherein each bristle head is movable between an extended position and an inward position and wherein the springs resiliently bias the bristle heads in the direction of the extended position; and wherein the substantially cylindrical body has a central axial bore running therethrough and each housing extends substantially across the central axial bore.

8. A cleaning tool according to claim 7 wherein each bristle head is attached to a respective housing.

9. A cleaning tool according to claim 7, configured to allow each spring to be removed from the housing in which each spring is received when the bristle head is removed.

10. A cleaning tool according to claim 7 wherein the bristle heads are helically arranged around the body.

11. A cleaning tool according to claim 10 wherein the housings are offset from the body diameter such that there is a central unobstructed flow path along the central axial bore of the cleaning tool.

12. A cleaning tool according to claim 10 comprising two rows of bristle heads arranged about the body and extending therefrom in substantially opposite directions.

13. A cleaning tool according to claim 7 wherein the central axial bore is fluidicly isolated from an external surface of the body.

14. A cleaning tool for a pipe comprising:

a substantially cylindrical body;

a plurality of holes within the substantially cylindrical body;

brush inserts located within the plurality of holes wherein the brush inserts each comprise a housing closed at one end to form a chamber in which a spring is located and a bristle head is located in an open end of the chamber of the housing, permitting the bristle heads to extend radially from the substantially cylindrical body;

wherein each bristle head is movable between an extended position and an inward position and wherein the springs resiliently bias the bristle heads out of the chamber in the direction of the extended position, and wherein the body has a central axial bore running therethrough and each housing extends substantially across the central axial bore.

15. A cleaning tool for a pipe comprising:

a substantially cylindrical body;

a plurality of holes within the substantially cylindrical body;

brush inserts located within the plurality of holes wherein the brush inserts each comprise a housing closed at one end to form a chamber in which a spring is located and a bristle head is located in an open end of the chamber of the housing, permitting the bristle heads to extend radially from the substantially cylindrical body;

wherein each bristle head is movable between an extended position and an inward position and wherein the springs resiliently bias the bristle heads out of the chamber in the direction of the extended position, and wherein the bristle heads are helically arranged around the body.

16. A cleaning tool according to claim 15 wherein the body has a central axial bore running therethrough and each housing extends substantially across the central axial bore and the housings are offset from the body diameter such that there is a central unobstructed flow path along the central axial bore of the cleaning tool.

17. A cleaning tool according to claim 15 comprising two rows of bristle heads arranged about the body and extending therefrom in substantially opposite directions.

18. A cleaning tool for a pipe comprising:

a substantially cylindrical body;

a plurality of holes within the substantially cylindrical body;

brush inserts located within the plurality of holes wherein the brush inserts each comprise a housing closed at one end to form a chamber in which a spring is located and a bristle head is located in an open end of the chamber of the housing, permitting the bristle heads to extend radially from the substantially cylindrical body;

wherein each bristle head is movable between an extended position and an inward position and wherein the springs resiliently bias the bristle heads out of the chamber in the direction of the extended position, and wherein an external surface of the body has at least one bristle bypass channel therein extending substantially from one end of the body to the other.

19. A cleaning tool according to claim 18 wherein the bypass channel is helical.

20. A cleaning tool according to claim 19 comprising two bypass channels substantially opposite one another.

* * * * *